US005845804A

United States Patent [19]

Prescott

[11] Patent Number: 5,845,804

[45] Date of Patent: Dec. 8, 1998

[54] INSULATOR APPARATUS FOR A BEVERAGE CONTAINER

[76] Inventor: Charles R. Prescott, 1134 Robert St., Pearland, Tex. 77581

[21] Appl. No.: 958,514

[22] Filed: Oct. 27, 1997

[51] Int. Cl.[6] ..... B65D 23/08

[52] U.S. Cl. ..... 220/400; 215/12.1; 220/739; 220/903

[58] Field of Search ..... 206/423, 477; 215/12.1, 13.1; 220/400, 737–741, 903

[56] References Cited

U.S. PATENT DOCUMENTS

| | | | |
|---|---|---|---|
| 3,410,023 | 11/1968 | Anello | 46/123 |
| 4,087,989 | 5/1978 | Taran | 63/11 |
| 4,648,525 | 3/1987 | Henderson | 220/739 |
| 4,724,548 | 2/1988 | London | 2/338 |
| 5,109,588 | 5/1992 | Hewlett et al. | 29/525.1 |
| 5,163,608 | 11/1992 | Block | 229/92.8 |
| 5,176,452 | 1/1993 | Stern | 383/43 |
| 5,256,131 | 10/1993 | Owens et al. | 493/374 |
| 5,318,821 | 6/1994 | Bradley, Jr. | 220/739 |
| 5,325,991 | 7/1994 | Williams | 220/739 |
| 5,373,942 | 12/1994 | Weder | 206/423 |
| 5,579,949 | 12/1996 | Dykes et al. | 220/739 |
| 5,609,265 | 3/1997 | Haberkorn et al. | 220/739 |

*Primary Examiner*—Jim Foster
*Attorney, Agent, or Firm*—Harrison & Egbert

[57] ABSTRACT

An insulator apparatus for a beverage container having a section of foam material with a generally rectangular configuration, a first self-coiling spring strip affixed adjacent to a top edge of the section of foam material, and a second self-coiling spring strip affixed adjacent to a bottom edge of the section of foam material. The first self-coiling spring strip is in generally parallel relationship to the second self-coiling spring strip. The first and second self-coiling spring strips operate so as to self-roll the section of foam material around an exterior surface of the beverage container. Each of the first and second self-coiling spring strips have a concave side and a convex side and the property that, when straightened, the spring strip holds a straightened shape and, when bent in a predetermined direction, the spring strip self-rolls to encircle the beverage container. The first and second self-coiling spring strips are of identical configurations.

20 Claims, 1 Drawing Sheet

INSULATOR APPARATUS FOR A BEVERAGE CONTAINER

TECHNICAL FIELD

The present invention relates to devices for insulating beverage containers. More particularly, the present invention relates to devices for fixing around an exterior surface of a can or bottle so as to prevent the loss of heat or the gain of temperature of the liquid within the container.

BACKGROUND ART

Various types of container holders have long been popular for glasses and cans, particularly where the object being held is a cold drink. Oftentimes, these "coaster" type devices are provided with some type of insulation so as to help keep the container being held cool. Another advantage of using this type of device is that the person drinking from the container does not have to touch the container which, because of the warm air striking the cool container, will cause moisture to condense and run down the sides.

Unfortunately, most of the prior art containers are inconvenient to ship, transport, store and display. The molded cylindrical nature of these insulating devices requires a great deal of shipping space be taken up by empty space. Since these beverage can holders are typically inexpensive items, a store can often "waste" a great deal of space when displaying these items. Even the most efficient management of space will not allow for a great number of such beverage can holders to be displayed in particular given area.

It is a common problem with conventional beverage can holders designs that it is quite difficult to install the can into the interior of the holder and to remove the can from the interior of the holder. Often, the interior cavity of the beverage can holder fits flush against the outer surface of the can. A vacuum or friction occurs between the inner surface of the beverage can holder and the surface of the can. This makes release of the can very difficult. Furthermore, the need to evacuate air from the interior of the beverage can holder when placing the can into the opening of the holder can make installation of the can into the holder difficult. In order to remove the beverage can from the interior of the beverage can holder, it is often necessary to squeeze and bend the can so as to a properly release of the can from the beverage can holder.

In the past, various U.S. patents have issued relating to such beverage can holders. For example, U.S. Pat. No. 5,109,588, issued on May 5, 1992 to Hewlett et al. describes a wrap for keeping a beverage container cool. This wrap is created by first forming a jacket assembly having inner and outer pockets. An insulating blanket is inserted into the outer pocket of the jacket assembly. A hook and pile fastener is then secured to the outer pocket covering the entrance opening so as to completely and permanently enclose the insulating blanket in the outer pocket. The other part of the fastener is secured to the other end of the jacket assembly on the other face to allow the ends to be connected together after the wrap is placed around the container.

U.S. Pat. No. 5,163,608, issued on Nov. 17, 1992 to J. D. Block teaches a combination post card/container insulator with a substantially rectilinear sheet of flexible insulating material to wrap around the container and fasteners to maintain the sheet wrapped around the container.

U.S. Pat. No. 5,256,131, issued on Oct. 26, 1993 to Owens et al. teaches a method of manufacturing a beverage cooling or heating wrap. This method includes the steps of providing a generally rectangular strip of material, superimposing and attaching a piece of insulation to the strip, twice folding the strip and insulation to create a three-layered bundle, securing the longitudinal edges of the bundle, inverting the bundle about the axis of one of the folds, inverting the bundle about the axis of the other fold, and securing the fasteners to the bundle.

U.S. Pat. No. 5,579,949, issued on Dec. 3, 1996 to Dykes et al. teaches an insulative "C"-shaped sleeve for a beverage cup. This plastic molded shape has two broadened ends connected by a thinner central strip wherein the body is conically arrayed about an axis which intersects the center of the shape. The "C" shape is sized to be slightly under the diameter of a conventional hot beverage cup and to snap onto the sidewall of the beverage cup and hold it in a spring-like fashion.

In the past, various patents have issued relating to self-coiling spring strips. For example, U.S. Pat. No. 5,176,452, issued on Jan. 5, 1993 to M. Stern utilizes a spring strip so as to create a self-closing bag. U.S. Pat. No. 4,724,548, issued on Feb. 16, 1988 to J. London describes a hugging novelty device in which hands or connected to opposite ends of the spring strip so as to simulate a grabbing action by the hands. U.S. Pat. No. 3,410,023, issued on Nov. 12, 1968 to J. Anello describes a novelty toy in which a head is connected to a top of the spring strip and a tail is connected to an opposite end of the spring strip so as to simulate the image of a bird. U.S. Pat. No. 4,087,989, issued on May 9, 1978 to J. D. Taran describes a bracelet which utilizes a spring strip.

It is an object of the present invention to provide an insulator apparatus for a beverage container which allows the insulator to be easily and quickly wrapped around a beverage container and to be easily removed from such beverage container.

It is another object of the present invention to provide an insulator apparatus for a beverage container which can be stored in a flat condition.

It is a further object of the present invention to provide an insulator apparatus for a beverage container which effectively establishes a strong and secure contact with the exterior surface of the beverage can.

It is still a further object of the present invention to provide an insulator apparatus for a beverage container which automatically rolls around the exterior of the beverage can and adapts to various diameters of beverage cans.

It is still another object of the present invention to provide an insulator apparatus for a beverage container which is relatively inexpensive, easy to manufacture, and easy to use.

These and other objects and advantages of the present invention will become apparent from a reading of the attached specification and appended claims.

SUMMARY OF THE INVENTION

The present invention is an insulator apparatus for a beverage container that comprises a section of foam material having a generally rectangular configuration, a first self-coiling spring strip affixed adjacent to a top edge of the section of foam material, and a second self-coiling spring strip affixed adjacent to a bottom edge of the section of foam material. The first self-coiling spring strip is in generally parallel relationship to the second self-coiling spring strip. The first and second self-coiling spring strips operate so as to self-roll the section of foam material around an exterior surface of the beverage container. Each of the first and second self-coiling spring strips has a concave side and a convex side. These spring strips have the property that, when straightened, the spring strip holds a straightened shape and, when bent in a predetermined direction, the spring strip self-rolls to encircle the beverage container.

Each of the first and second spring strips have identical configurations. These spring strips are embedded within the section of foam material. The first spring strip has ends which terminate in linear alignment with ends of the second self-coiling spring strip. The first self-coiling spring strip is positioned such that the concave side faces a similar direction as the second self-coiling spring strip. The spring strips extend longitudinally across the section of foam material.

DETAILED DESCRIPTION OF THE INVENTION

Figure 1:
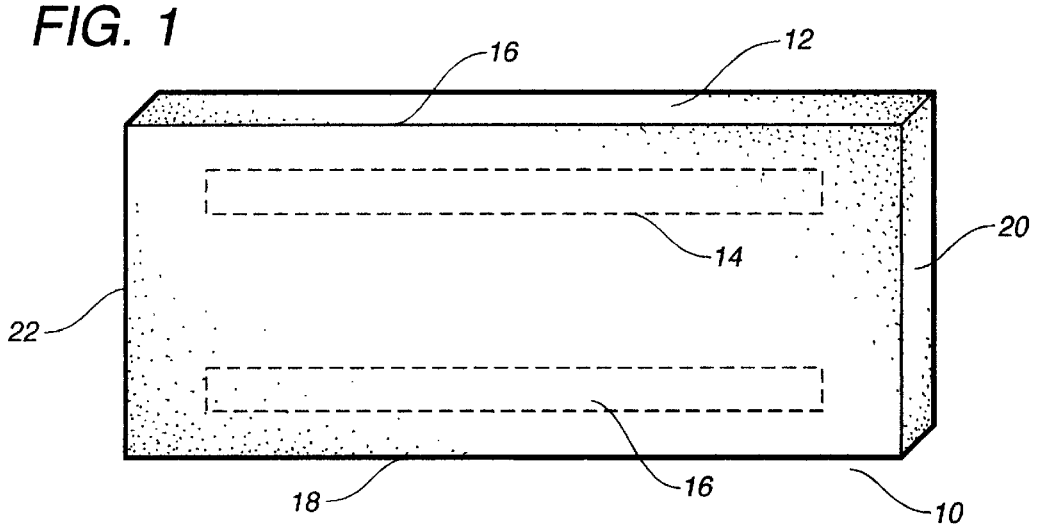
FIG. 1 is a frontal perspective view of the insulator apparatus in accordance with the preferred embodiment of the present invention.

Referring to FIG. 1, there is shown at 10 the insulator apparatus for beverage containers in accordance with the preferred embodiment of the present invention. Insulator apparatus 10 includes a section of foam material 12 having a length dimension and a width dimension. A first self-coiling spring strip 14 is embedded within the section of foam material 12 adjacent to the top edge 16. A second self-coiling spring strip 16 is embedded in the section of foam material 12 adjacent to the bottom edge 18.

The section of foam material 12 has a generally rectangular configuration. Specifically, in the preferred embodiment of the present invention, the foam material 12 is foam rubber. The section of foam material 12 should have a suitable length so as to be slightly less than the circumference of the beverage container. The section of foam material 12 should have a suitable width so as to extend substantially along the height of the intended beverage container. The more exterior surface area of the beverage container that can be encircled by the section of foam material 12, the better the insulating properties of the foam material 12. The section of foam material 12 has a first end 20 and a second end 22. When placed around the beverage container, end 20 will be in close proximity to end 22 when the section of foam material 12 is formed into a generally tubular configuration.

So as to facilitate the ability of the section of foam material 12 to assume a tubular configuration, self-coiling spring strips 14 and 16 are affixed to the section of foam material 12. In the preferred embodiment of the present invention, strips 14 and 16 are embedded within the foam material 12. However, and alternatively, the spring strips 14 and 16 could be placed on an exterior surface of the section of foam material 12. The first self-coiling spring strip 14 is arranged in generally parallel relationship to the second self-coiling spring strip 16. The ends of each of the spring strips 14 and 16 are positioned so as to be in generally linear alignment. The first and second spring strips 14 operate so as to self-roll the section of foam material 12 around the exterior surface of the beverage container. As will be described hereinafter, each of the first self-coiling spring strip 14 and the second self-coiling spring strip 16 has a concave side and a convex side. These spring strips 14 and 16 have the property that, when straightened, the spring strip holds a straightened shape and, when bent in a predetermined direction, the spring strip self-rolls so as to encircle the container. The spring strips 14 and 16 extend longitudinally across the section of foam material 12. Each of the spring strips 14 and 16 has a concave side facing in the same direction. The spring strips 14 and 16 have similar configurations.

In the preferred embodiment of the present invention, each of the first and second spring strips have a length of at least eight inches, a width of at least 11/16 of an inch, and a thickness of between 0.007 and 0.010 inches. The section of foam material 12 will have a length of no less than eight inches, a width of no less than four inches, and a thickness of no less than ¼ inch. These dimensions are for the preferred embodiment of the present invention as used with beverage cans. These dimensions can be suitably altered so as to allow the insulator apparatus 10 to be adapted to other types of beverage containers.

Figure 2:
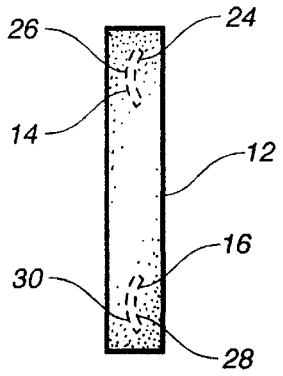
FIG. 2 is an end view of the insulator apparatus of the present invention.

FIG. 2 shows an end view of the section of foam material 12. As can be seen, in FIG. 2, the first self-coiling spring strip 14 has a concave side 24 and a convex side 26. Similarly, the second self-coiling spring strip 16 has a concave side 28 and a convex side 30. In FIG. 2, it can be seen that the concave sides 24 and 28 face the same direction. Similarly, the convex sides 26 and 30 face the same direction, i.e. the direction opposite the concave sides 24 and 28.

Figure 3:
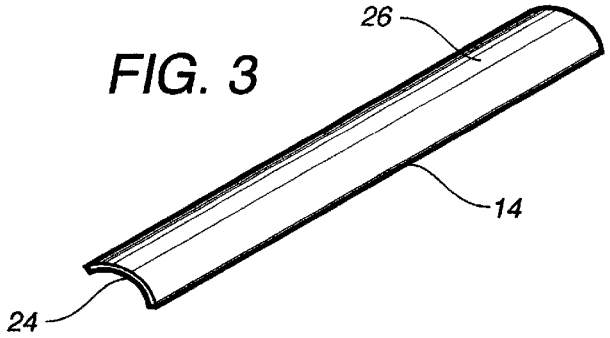
FIG. 3 is an isolated perspective view of one of the self-coiling spring strips as used in the present invention in its straightened condition.
Figure 4:
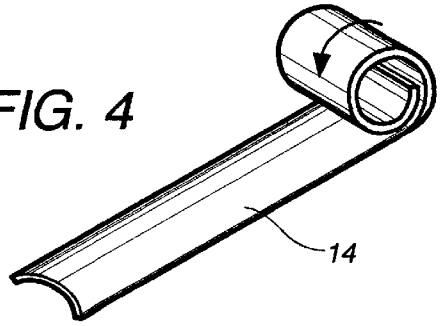
FIG. 4 is an isolated perspective view of one of the self-coiling spring strips as shown in its self-rolling condition.

FIG. 3 shows an isolated view of spring strip 14. As can be seen, spring strip 14 has concave side 24 and convex side 26. When straightened, as shown in FIG. 3, the concave/convex surfaces tend to keep the strip 14 straight. However, once a bending of the strip 14 is initiated, it self-rolls itself as illustrated in FIG. 4. The arrow in FIG. 4 illustrates the rolling the direction of one end of the self-rolling spring strip 14 towards the other end. The roll up power of the spring strip 14 will vary in accordance with the width of the strip and its thickness. It is therefore easy to provide the spring strip 14 with different roll-up forces for different requirements of use. During storage, the spring strip 14 should be in the position illustrated in FIG. 3 so that the section of foam material 12 remains flat. During actual use, the spring strips 14 and 16 should be slightly bent so as to cause the roll up as shown in FIG. 4.

Figure 5:
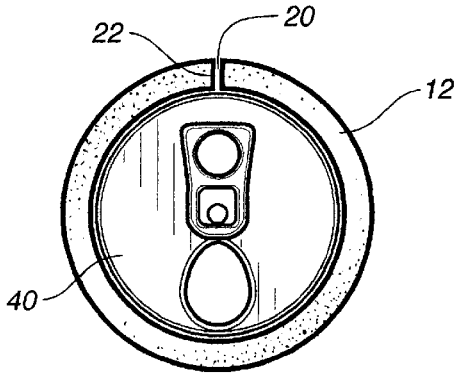
FIG. 5 is a plan view showing the insulator apparatus of the present invention as applied around a beverage container.

FIG. 5 illustrates the manner in which the section of foam material 12 can be applied around a beverage container 40. As can be seen in FIG. 5, the section of foam material 12 will encircle the exterior surface of the can 40 such that the ends 20 and 22 reside in close proximity. In the preferred embodiment of the present invention, the ends 20 and 22 will not overlap since the length of the section of foam material 12 is less than the circumference of the can 40. However, if ultimate insulating capacity is required without regard to appearance, then the ends 20 and 22 can overlap so as to eliminate any gaps.

With reference to FIG. 5, in order to remove the section of foam material 12 from the exterior surface of the beverage can 40, it is only necessary to separate the ends 20 and 22 so as to bring the section of foam material 12 toward a straightened condition. When the section of foam material 12, along with the strips 14 and 16, are suitably straightened, then the insulator apparatus 10 will assume its flat and straight condition for storage. The strength of the spring strips 14 and 16 assures a very tight relationship between the surface of the section of foam material 12 and the exterior surface of the beverage container 40. This maximizes the insulative qualities of the apparatus 10.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An insulator apparatus for a beverage container comprising:

a section of foam material having a generally rectangular configuration;

a first self-coiling spring strip affixed adjacent to a top edge of said section of foam material; and a second self-coiling spring strip affixed adjacent to a bottom of said section of foam material, said first self-coiling spring strip being in generally parallel relationship to said second self-coiling spring strip, said first and second self-coiling spring strips operating so as to self-roll said section of foam material around an exterior surface of the beverage container, each of said first and second self-coiling spring strips having a concave side and a convex side and the property that when straightened the spring strip holds a straightened shape and when bent in a predetermined direction the spring strip self-rolls to encircle the beverage container.

2. The apparatus of claim 1, each of said first and second self-coiling spring strips having identical configurations.

3. The apparatus of claim 1, said first and second self-coiling spring strips being embedded within said section of foam material.

4. The apparatus of claim 1, said first self-coiling spring strip having ends terminating in linear alignment with ends of said second self-coiling spring strip.

5. The apparatus of claim 3, said first self-coiling spring strip positioned such that the concave side faces a similar direction as the concave side of said second self-coiling spring strip.

6. The apparatus of claim 1, said section of foam material being of foam rubber material.

7. The apparatus of claim 1, each of said first and second self-coiling spring strips having a length of at least eight inches, a width of at least 11/16 inch, and a thickness of between 0.007 and 0.010 inches.

8. The apparatus of claim 7, said section of foam material having a length of no less than eight inches, a width of no less than four inches, and a thickness of no less than ¼ inch.

9. An insulator apparatus for a beverage container comprising:

a section of foam material;

a first self-coiling spring strip embedded within said section of foam material; and a second self-coiling spring strip embedded within said section of foam material, said first self-coiling spring strip being in parallel relationship to said second self-coiling spring strip, each of said first and second self-coiling spring strips having a concave side and a convex side and the property that when straightened the spring strip holds a straightened shape and when bent in a predetermined direction the spring strip self-rolls to encircle the beverage container, said first and second self-coiling spring strips extending longitudinally across said section of foam material.

10. The apparatus of claim 9, each of said first and second self-coiling spring strips being of identical configurations.

11. The apparatus of claim 9, said first self-coiling spring strip having ends terminating in linear alignment with ends of said second self-coiling spring strip, said first self-coiling spring strip positioned adjacent to a top edge of said section of foam material, said second self-coiling spring strip positioned adjacent to a bottom edge of said section of foam material.

12. The apparatus of claim 9, said first self-coiling spring strip positioned such that the concave side faces a similar direction as the concave side of said second self-coiling spring strip.

13. The apparatus of claim 9, said section of foam material having a generally rectangular configuration, said first and second self-coiling spring strips extending transverse to a width of said generally rectangular configuration.

14. The apparatus of claim 9, said section of foam material having a length less than a circumference of the beverage container.

15. An insulator for a beverage container comprising:

a section of foam material having a length dimension and a width dimension;

a first self-coiling spring strip affixed to said section of foam material ; and a second self-coiling spring strip affixed to said section of foam material in parallel relationship to said first self-coiling spring strip, said first and second self-coiling spring strips operating so as to self-roll said section of foam material around an exterior surface of the beverage container, each of said first and second self-coiling spring strips having a concave side and a convex side, said concave side of said first self-coiling spring strip facing a similar direction as said concave side of said second self-coiling spring strip, each of said first and second self-coiling spring strips having the property that when straightened the spring strip holds a straightened shape and when bent in a predetermined direction the spring strip self-rolls to encircle the beverage container.

16. The apparatus of claim 15, said first self-coiling spring strip positioned adjacent a top edge of said section of foam material along said length dimension.

17. The apparatus of claim 16, said second self-coiling spring strip positioned adjacent a bottom edge of said section of foam material along said length dimension.

18. The apparatus of claim 15, each of said first and second self-coiling spring strips being embedded within said section of foam material.

19. The apparatus of claim 15, each of said first and second self-coiling spring strips being of identical configurations.

20. The apparatus of claim 15, said first self-coiling spring strip having ends terminating in linear alignment with ends of said second self-coiling spring strip.

* * * * *